US007303269B2

(12) United States Patent
Shiota

(10) Patent No.: US 7,303,269 B2
(45) Date of Patent: Dec. 4, 2007

(54) RECORDING APPARATUS AND LIQUID EJECTING APPARATUS

(75) Inventor: Takayuki Shiota, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/590,074

(22) Filed: Oct. 30, 2006

(65) Prior Publication Data

US 2007/0046745 A1 Mar. 1, 2007

Related U.S. Application Data

(62) Division of application No. 10/840,801, filed on May 7, 2004.

(30) Foreign Application Priority Data

May 8, 2003 (JP) ..... 2003-130212
Aug. 28, 2003 (JP) ..... 2003-305354

(51) Int. Cl.
*B41J 2/175* (2006.01)

(52) U.S. Cl. ..... 347/85; 347/84; 347/86

(58) Field of Classification Search ..... 347/84, 347/85, 86, 87, 2, 5, 106, 108
See application file for complete search history.

(56) References Cited

U.S. PATENT DOCUMENTS 4,881,132 A 11/1989 Lajos
5,221,035 A 6/1993 Suzuki et al.
5,365,844 A 11/1994 Miyashige
5,505,550 A 4/1996 Kitahara et al.
5,548,390 A 8/1996 Sugisaki et al.
5,764,263 A 6/1998 Lin
5,894,313 A 4/1999 Mabuchi
5,966,155 A * 10/1999 Pawlowski et al. ..... 347/85
6,089,487 A 7/2000 Imai et al.
6,238,113 B1 5/2001 Dodge
6,493,098 B1 12/2002 Cornell (Continued)

FOREIGN PATENT DOCUMENTS

EP 0 317 762 A2 5/1989

(Continued)

OTHER PUBLICATIONS

European Search Report (Feb. 25, 2002).

(Continued)

*Primary Examiner*—Lam Son Nguyen
(74) *Attorney, Agent, or Firm*—John J. Penny, Jr.; Edwards Angell Palmer & Dodge LLP

(57) ABSTRACT

A printer shaped like a slim box includes a carriage which reciprocates in a main scanning direction on its front section. Ink cartridges separately from the carriage are detachably provided in an ink cartridge unit in a row in the main scanning direction above a main scanning area of the carriage. The ink cartridge unit is designed to retreat from an area in the vicinity of the main scanning area of the carriage by sliding in a backward direction of the printer, whereby maintenance work can be easily performed when a trouble (e.g. paper jam) occurs in a recording paper transfer path via an area below a bottom section of the carriage.

1 Claim, 17 Drawing Sheets

U.S. PATENT DOCUMENTS

| | | | | |
|---|---|---|---|---|
| 6,505,924 | B2 * | 1/2003 | Shimizu | 347/86 |
| 2002/0051669 | A1 | 5/2002 | Otsuka et al. | 400/619 |

FOREIGN PATENT DOCUMENTS

| | | | |
|---|---|---|---|
| EP | 0 700 788 | A2 | 3/1996 |
| JP | 54-006534 | | 1/1979 |
| JP | 7-237336 | | 9/1995 |
| JP | 08-337011 | | 12/1996 |
| JP | 10-166566 | A | 6/1998 |
| JP | 11-34403 | | 2/1999 |
| JP | 2000-335028 | | 12/2000 |
| JP | 2001-146006 | A | 5/2001 |
| JP | 2002-001993 | | 1/2002 |
| JP | 2002-154245 | | 5/2002 |

OTHER PUBLICATIONS

Machine Translation of JP 11034403.

* cited by examiner

RECORDING APPARATUS AND LIQUID EJECTING APPARATUS

This is a divisional application of U.S. application Ser. No. 10/840,801 filed on May 7, 2004.

The present application claims a priority from Japanese Patent Applications Nos. 2003-130212 filed on May 8, 2003 and 2003-305354 filed on Aug. 28, 2003, the contents of which are incorporated herein by reference.

BACKGROUND OF THE INVENTION

1. Field of the Invention

The present invention relates to a recording apparatus and a liquid ejecting apparatus which include an ink cartridge for supplying ink drops to a recording head which is provided separately from a carriage.

Here, the liquid ejecting apparatus is not limited to a recording apparatus which employs an inkjet type recording head for performing recording on a recording medium by ejecting ink from the recording head such as a printer, copier, facsimile, etc. but also includes an apparatus for ejecting liquid, in place of ink, onto a liquid ejection medium, a counterpart of the recording medium, from a liquid ejecting head, a counterpart of the inkjet type recording head, and putting the liquid on the liquid ejection medium.

As the liquid ejecting head, besides the recording head, there are a color material ejecting head used for manufacture of a color filter such as a liquid crystal display, an electrode material (conductive paste) ejecting head used for manufacture of an electrode such as an organic EL display or field emission display (FED), a bioorganic material ejecting head for used for manufacture of a biochip, a sample ejecting head as a minute pipette, etc.

2. Related Art

An inkjet printer as a recording apparatus includes an inkjet type recording head for ejecting ink drops which is mounted on a carriage reciprocating in a main scanning direction. Here in the inkjet printer an ink cartridge for supplying ink drops to the inkjet type recording head is detachably provided, where the ink cartridge is not mounted on the carriage, but is fixed to the apparatus body side of the inkjet printer separately from the carriage as disclosed in, for example, Japanese Patent Application Publication (Laid-Open) No. 2002-154245. In such configuration, the ink cartridge and the inkjet type recording head are connected via an ink tube of plasticity. By this configuration, it is possible to make the capacity of the ink cartridge large, as well as making the carriage small in size and light in weight and improving drive precision.

Here, if a plurality of ink cartridges in response to a plurality of colors are arranged above a main scanning area of the carriage, since the transfer path of the recording medium is generally positioned below the carriage, there occurs a problem that if any trouble happens to the transfer path, the ink cartridges provided above the main scanning area of the carriage become obstacles, so it is difficult to perform maintenance work. For example, if a paper happens to jam, there occurs a problem that the ink cartridges become obstacles, so it is difficult to perform the work of eliminating the paper which jams.

SUMMARY OF THE INVENTION

Therefore, it is an object of the present invention to provide a recording apparatus and a liquid ejecting apparatus including an ink cartridge positioned above the main scanning area of a carriage, wherein even if any trouble happens to the transfer path, it is easy to perform maintenance work, which is capable of overcoming the above drawbacks accompanying the conventional art. The above and other objects can be achieved by combinations described in the independent claims. The dependent claims define further advantageous and exemplary combinations of the present invention.

According to the first aspect of the present invention, a recording apparatus which includes a recording head for performing recording on a recording medium, a carriage which reciprocates in a main scanning direction, and an ink cartridge provided separately from the carriage for supplying ink drops to the recording head, the recording apparatus includes ink cartridge retreat means for positioning the ink cartridge in an area in the vicinity of a main scanning area of the carriage or making the ink cartridge retreat from the area in the vicinity of the main scanning area of the carriage, wherein the recording medium is transferred along a recording medium transfer path via the recording head.

Accordingly, since the recording apparatus includes the ink cartridge retreat means for positioning the ink cartridge separately from the carriage in the area in the vicinity of the main scanning area of the carriage or making the ink cartridge retreat from the area in the vicinity of the main scanning area of the carriage, when a trouble occurs in recording medium transfer path, it can secure a space above the main scanning area of the carriage. Therefore, even if a trouble such as a paper jam occurs in recording medium transfer path via the recording head, the maintenance work can be easily performed.

The carriage and the ink cartridge may be provided on a front section of the recording apparatus.

Accordingly, since the carriage and the ink cartridge are provided on a front section of the recording apparatus, attachment and detachment work of the ink cartridge can be easy, and the maintenance work can be easier when a trouble such as a paper jam occurs in recording medium transfer path.

The recording apparatus may further include an ink cartridge unit for detachably holding a plurality of the ink cartridges which are arranged along the main scanning direction of the carriage, wherein the ink cartridge retreat means may make the ink cartridge unit retreat from the area in the vicinity of the main scanning area of the carriage.

Accordingly, since the plurality of the ink cartridges are held being arranged along the main scanning direction of the carriage by the ink cartridge unit, the height of the recording apparatus can be made low. In addition, since the ink cartridge retreat means makes the ink cartridge unit retreat from the area in the vicinity of the main scanning area of the carriage, a plurality of ink cartridges can retreat quickly and easily.

The ink cartridge unit and a substantially box-shaped housing for covering the recording apparatus may form an outer top section of the recording apparatus, and the recording medium transfer path may be exposed by making the ink cartridge unit retreat from the area in the vicinity of the main scanning area of the carriage.

Accordingly, since the ink cartridge unit and the substantially box-shaped housing for covering the recording apparatus form the outer top section of the recording apparatus, and the recording medium transfer path is exposed by making the ink cartridge unit to retreat from the area in the vicinity of the main scanning area of the carriage, when the ink cartridge unit is moved in the retreat position, the maintenance work of the recording medium transfer path can be immediately performed, which is user-friendly.

The ink cartridge retreat means may slide the ink cartridge unit in a backward direction of the recording apparatus so as to make the ink cartridge unit retreat from the area in the vicinity of the main scanning area of the carriage.

Accordingly, since the ink cartridge retreat means slides the ink cartridge unit in a backward direction of the recording apparatus so as to make the ink cartridge unit retreat from the area in the vicinity of the main scanning area, even if the area above the housing and the ink cartridge unit is narrow when the recording apparatus is installed, the ink cartridge unit can retreat to the retreat position.

The ink cartridge unit may slide substantially horizontally on an inner top surface of the housing.

Accordingly, since the ink cartridge unit slides substantially horizontally on the inner top surface of the housing, even if the area above the housing and the ink cartridge unit is far narrower, the ink cartridge unit can retreat to the retreat position.

A flat top surface of the recording apparatus may be formed by a plate which makes a top surface of the ink cartridge unit and a top plate of the housing, and the ink cartridge retreat means may slide the ink cartridge unit in the backward direction of the recording apparatus, after the ink cartridge unit is moved in a non-interference position where the plate and top plate do not interfere with each other.

Accordingly, since the top surface of the recording apparatus becomes flat by way of a plate which makes a top surface of the ink cartridge unit and a top plate of the housing, the appearance is good, and since the ink cartridge unit is moved in the non-interference position where the plate and top plate do not interfere with each other, the ink cartridge unit can slide in the backward direction of the recording apparatus.

The ink cartridge retreat means may include energizing means for energizing the ink cartridge unit in a retreat direction, and stopper means for holding the ink cartridge unit in the area above the main scanning area of the carriage.

Accordingly, since if the holding state of the ink cartridge is released by the stopper means, the ink cartridge unit automatically retreats to the retreat direction by the energizing means, the ink cartridge unit can easily retreat to the retreat position.

The ink cartridge unit may include a body for mounting the ink cartridge, the body including a plurality of tongue pieces which extend in a forward direction of the recording apparatus, each of the tongue pieces including an engagement projection on a side surface of an end section of the tongue piece, a cover for covering a top section of the body, the cover including a plurality of engagement sections for engagement with the engagement projections, and a cap member for capping front sections of the body and cover, the engagement projections may be engaged with the engagement sections by elasticity of the tongue pieces, whereby the cover is held, and the engagement projections may be alternately formed on left and right side surfaces of the tongue pieces.

Accordingly, since the cap member is provided on the front section of the ink cartridge unit, and configured to be held by engaging the engagement projections provided on the body of the ink cartridge unit and the engagement sections of the cap member, while the engagement projections are alternately formed on left and right side surfaces of the tongue pieces, i.e. all of the engagement projections are not formed on the same surfaces, the cap member is not easily separated, whereby the inside of the ink cartridge unit can be surely protected.

According to the second aspect of the present invention, a liquid ejecting apparatus which includes a liquid ejecting head for performing liquid ejection on a liquid ejection medium, a carriage which reciprocates in a main scanning direction, and a liquid cartridge provided separately from the carriage for supplying liquid to the liquid ejecting head, the liquid ejecting apparatus includes liquid cartridge retreat means for positioning the liquid cartridge in an area in the vicinity of a main scanning area of the carriage or making the liquid cartridge retreat from the area in the vicinity of the main scanning area of the carriage, wherein the liquid ejection medium is transferred along a liquid ejection medium transfer path via the liquid ejecting head.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

This invention will now be described based on the preferred embodiments, which do not intend to limit the scope of the present invention, but exemplify the invention. All of the features and the combinations thereof described in the embodiment are not necessarily essential to the invention.

First, the schematic configuration of an inkjet printer (hereafter, referred to as "printer") 1 as an example of a "recording apparatus" or "liquid ejecting apparatus" according to a first exemplary embodiment of the present invention will be described referring to FIGS. 1 and 2. Here, FIG. 1 shows a perspective view of the printer 1, and FIG. 2 schematically shows a lateral sectional view of the printer 1.

Figure 1:
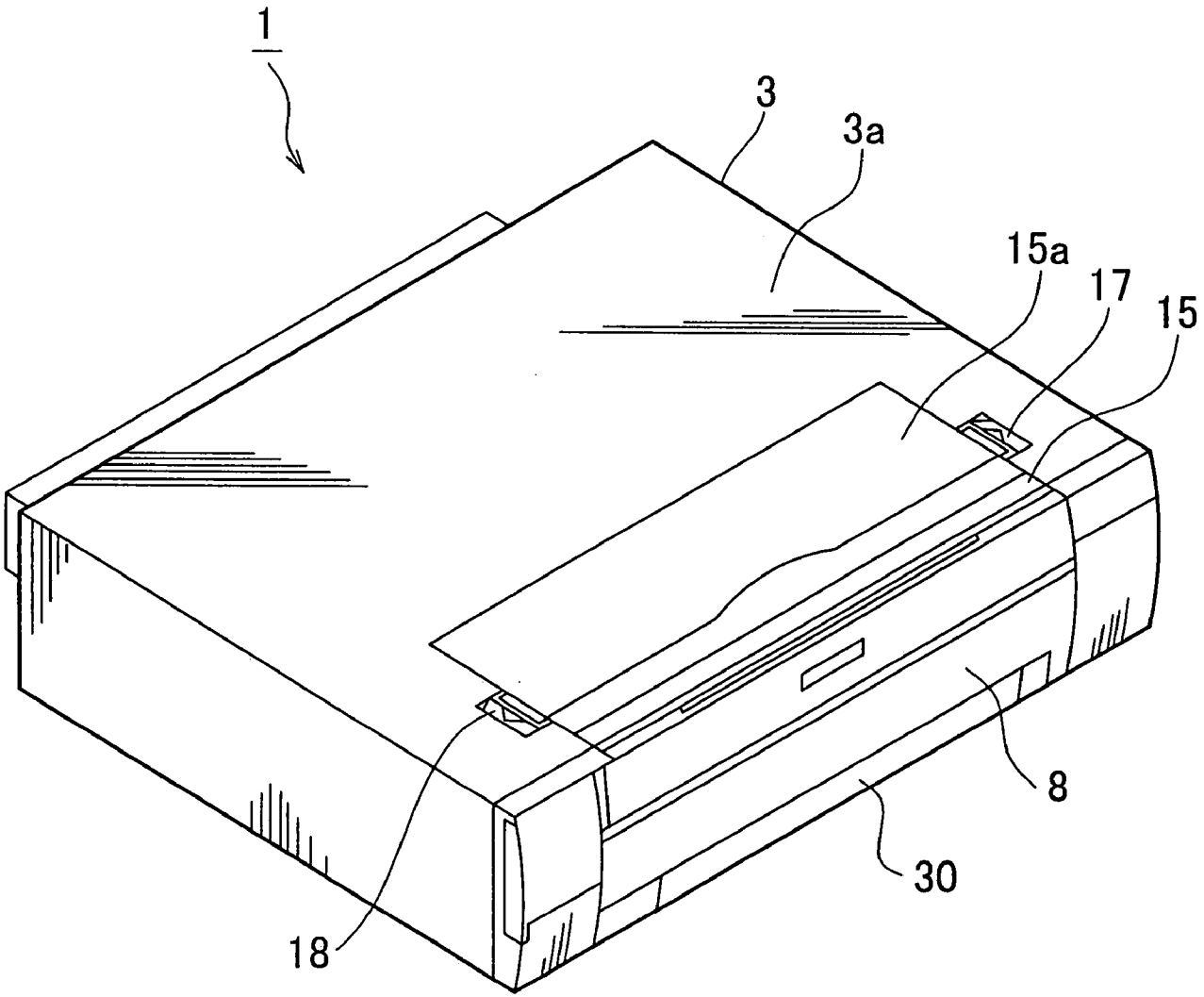
FIG. 1 shows a perspective view of a printer of the present invention.

As shown in FIG. 1, the printer 1 has a box-like shape whose size is approximately as large as a video tape recorder, and it is designed to be generally used being placed on a TV rack. The printer 1 is configured with a front cover 8 on a front surface of a box-shaped housing 3 as shown in the drawing, and the front cover 8 is pivotally provided changeable to a state (in use: not shown) where it opens forward or a state (out of use) where it is closed as shown in the drawing. In the state where it is closed, a recording paper on which recording has been performed can be discharged or a disk tray 33, as shown in FIG. 2, can come out of or get into it. A paper feed tray 30 is detachably provided below the front cover 8, and it is drawn forward and taken out, so that recording papers can be set. An ink cartridge unit 15 (which will be described in detail later) is provided above the front cover 8, and it forms a top surface of the printer 1 together with the housing 3. In addition, a plurality of ink cartridges 16, as shown in FIG. 3, are detachably provided on the ink cartridge unit 15 being arranged in a lateral direction of the printer 1.

Figure 2:
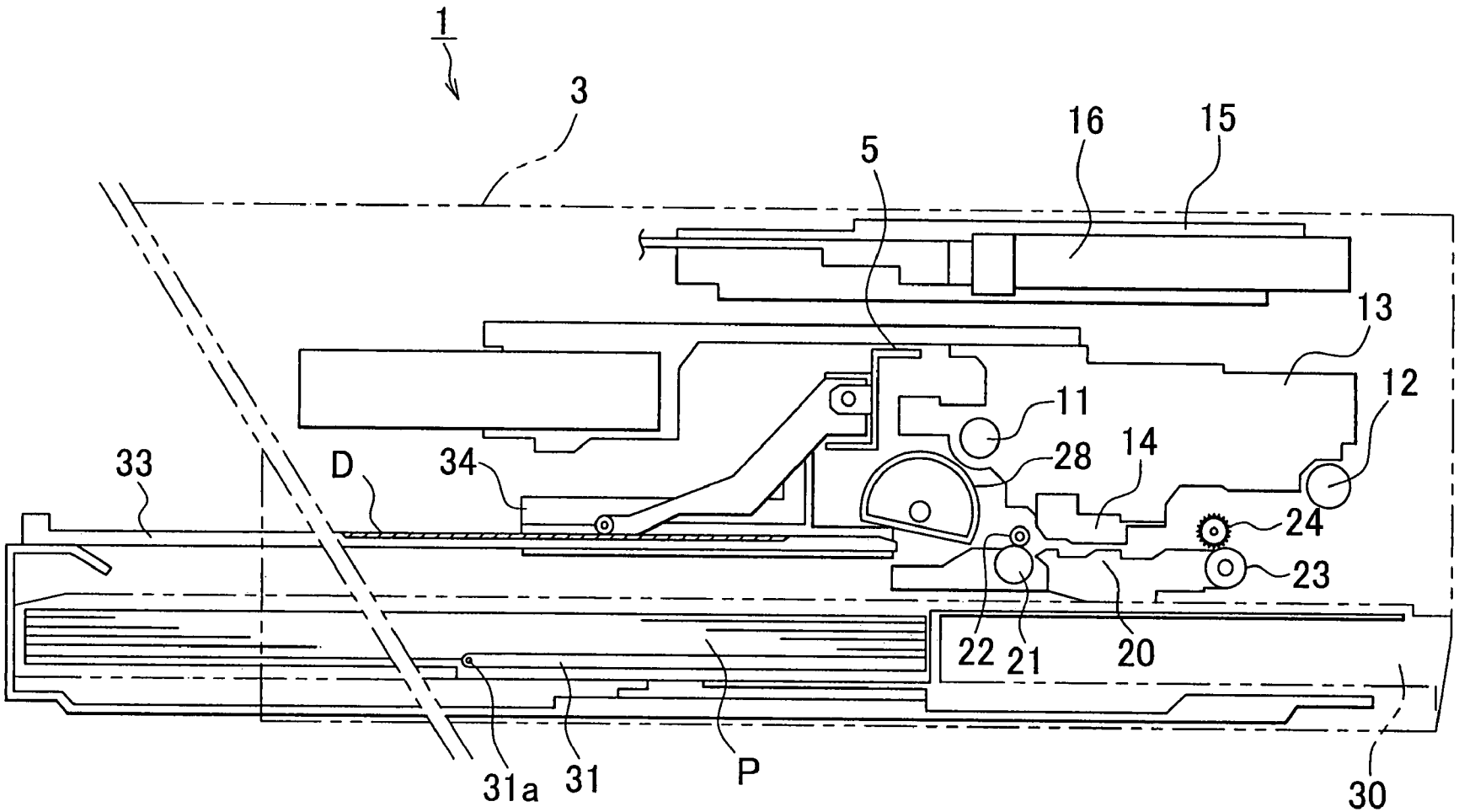
FIG. 2 shows a laterally sectional view of the printer of the present invention.
Figure 3:
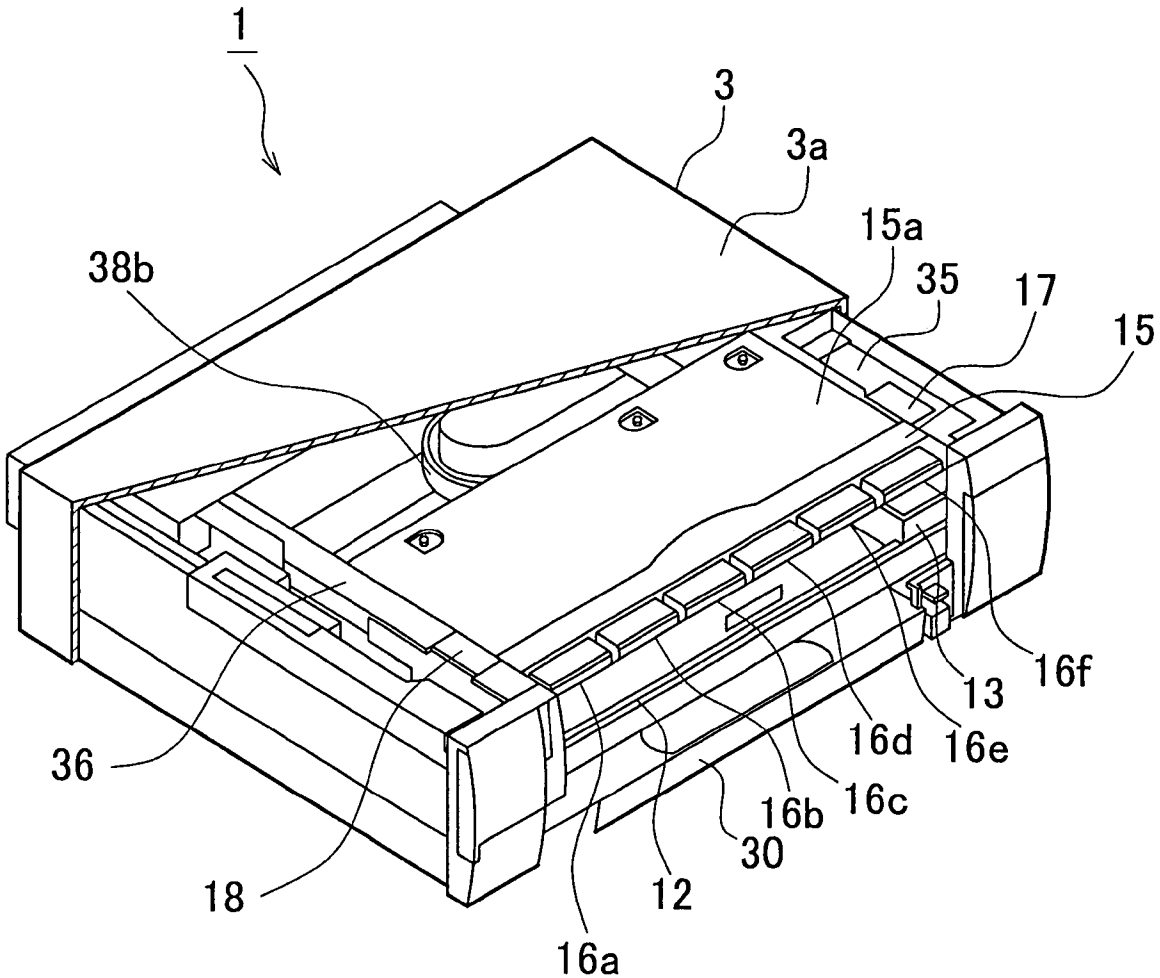
FIG. 3 shows a perspective view of the inside of the printer of the present invention.

Next, the internal configuration of the printer 1 will be schematically described referring to FIG. 2. The printer 1 is provided with the detachable paper feed tray 30 in its bottom section as described above. A plurality of recording papers P can be set in the form of a stack on the paper feed tray 30, below which a hopper 31 is provided. The hopper 31 is pivotally provided around a pivot shaft 31*a*, and it pivots receiving a driving force from driving means which is not shown, i.e. it pushes the recording papers P which are set upwards, whereby the recording papers P are forced to be pressed and contact the feed roller 28 which is provided above them.

The feed roller 28 has a D-shape when viewed from its side, and its outer surface is formed of a high friction material (e.g. rubber). When the recording papers P are transferred, one on the top of the recording papers P which are pressed and contact an arc section of the feed roller 28 is fed downstream (to the right in FIG. 2) by the rotation of the feed roller 28. And friction separation means (not shown) which is pressed and contact the arc section of the feed roller 28 is provided below the feed roller 28, and the recording papers P are interposed and pressed between the friction separation means and the feed roller 28, whereby the one on the top of the recording papers P which is to be transferred is separated from the rest of the recording papers P.

A driving transfer roller 21 which is rotatably driven by a transfer motor (not shown) and a driven transfer roller 22 which is rotated contacting and accompanying the driving transfer roller 21 are provided downstream of the feed roller 28, and the driving transfer roller 21 is rotatably driven with the recording paper P interposed between the driving and driven transfer rollers 21 and 22, so that the recording paper P is transferred downstream of a recording head 14.

The recording head 14 and a platen 20 are provided facing each other downstream of the driving transfer roller 21, and recording is performed on the recording paper P which is being transferred by ejecting ink drops as the "liquid" onto the recording head 14, while the paper is supported upwards by the platen 20. The recording head 14 is provided on a bottom section of a carriage 13, whereas any ink cartridge is not mounted on the carriage 13 which reciprocates in the main scanning direction, and the plurality of ink cartridges 16 as described are detachably arranged above the main scanning area of the carriage 13 in a row in the main scanning direction. And the ink is supposed to be supplied to the carriage 13 via an ink flow path which is not shown.

The carriage 13 is guided in the main scanning direction by a main carriage guide shaft 11 which extends in the main scanning direction and a sub-carriage guide shaft 12. The main carriage guide shaft 11 is inserted and passes though a rear section of the carriage 13, and the sub-carriage guide shaft 12 supports a front section of the carriage 13 upwards, whereby the distance between the recording head 14 and the recording papers P is regulated.

A driving discharge roller 23 which is rotatably driven by the transfer motor (not shown) and a driven discharge roller 24 which is rotated contacting and accompanying the driving discharge roller 23 are provided downstream of the recording head 14, and the driving discharge roller 23 is rotatably driven with the recording paper P interposed between the driving and driven discharge rollers 23 and 24, so that the recording paper P is discharged out of the printer 1.

Meanwhile, the disk tray 33 on which an optical disk D represented by a DVD (Digital Versatile Disk) is disposed above the paper feed tray 30. A rack which is not shown is formed on the side end of the disk tray 33, and it is configured to move approximately horizontally and straight by the rotation of a pinion gear which is not shown and geared with the rack. When recording is performed on the optical disk D, after an end of the tray is transferred by the above moving means until it is nipped between the driving and driven transfer rollers 21 and 22, the tray is transferred at a predetermined pitch under the recording head 14 receiving the driving force by the rotation of the driving transfer roller 21, so that the recording head 14 performs recording.

Figure 4:
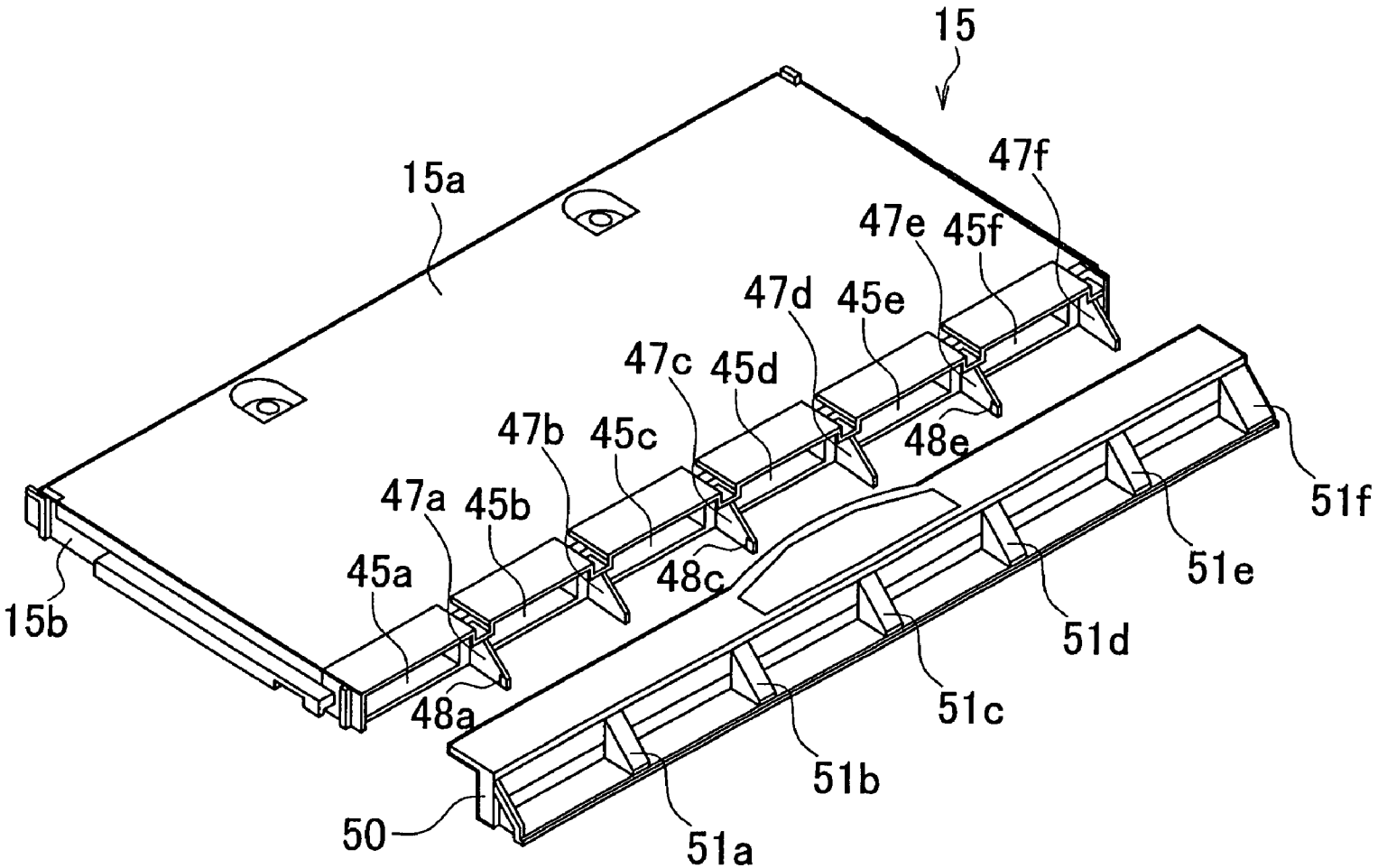
FIG. 4 shows a partially exploded perspective view of an ink cartridge unit.
Figure 5:
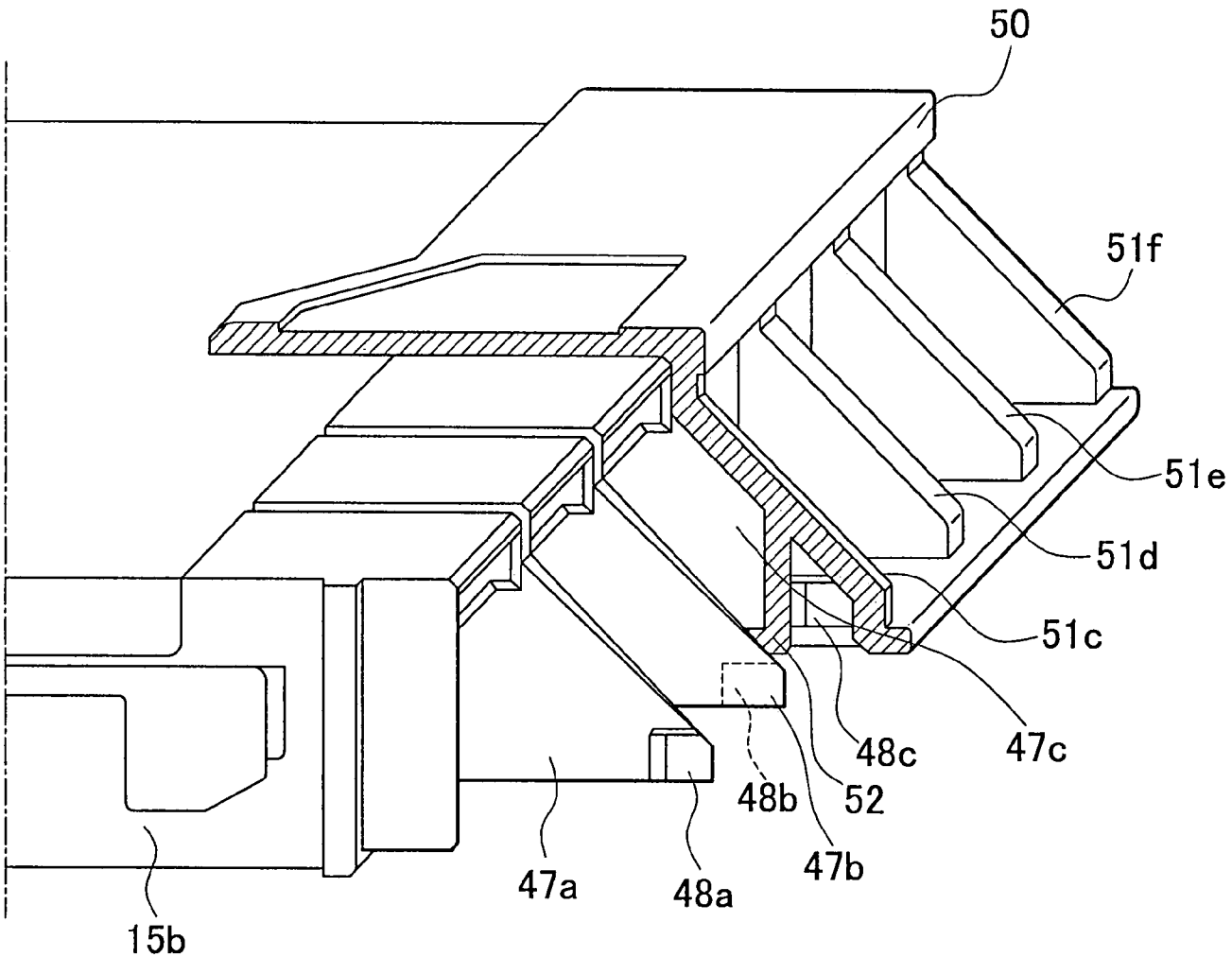
FIG. 5 shows a partially enlarged view of the ink cartridge unit.
Figure 9:
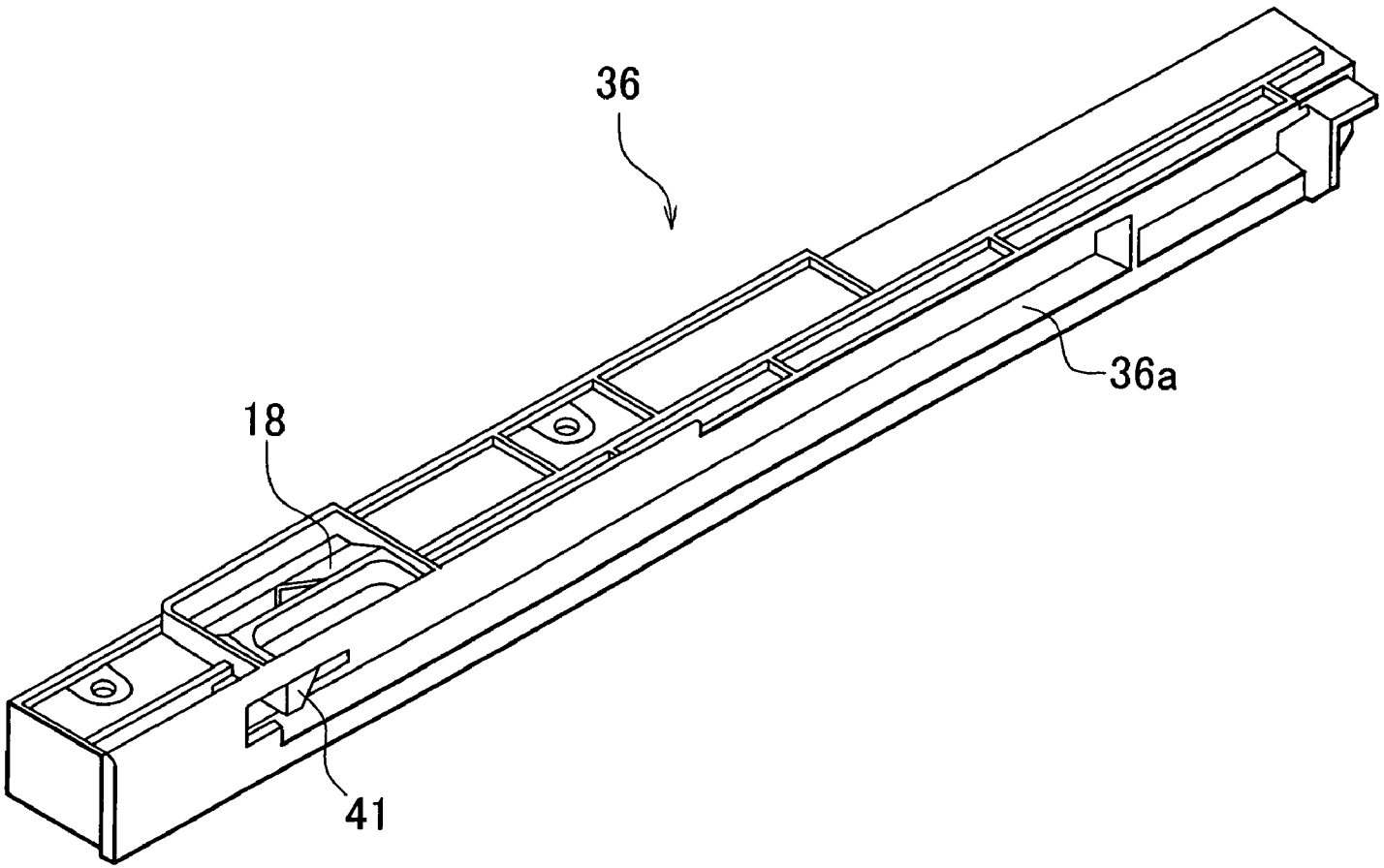
FIG. 9 shows a perspective view of a guide member.
Figure 10:
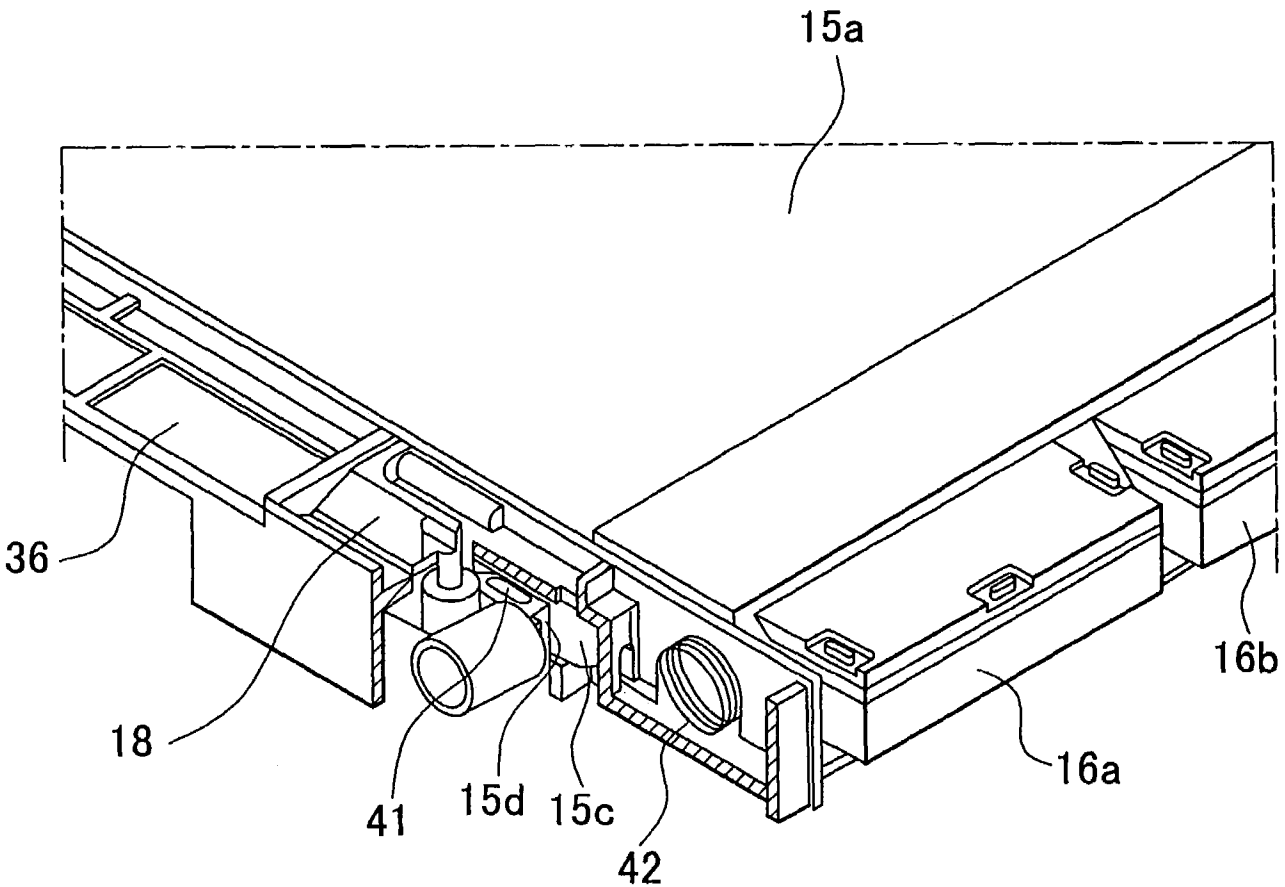
FIG. 10 shows a perspective view of a lock mechanism.
Figure 11:
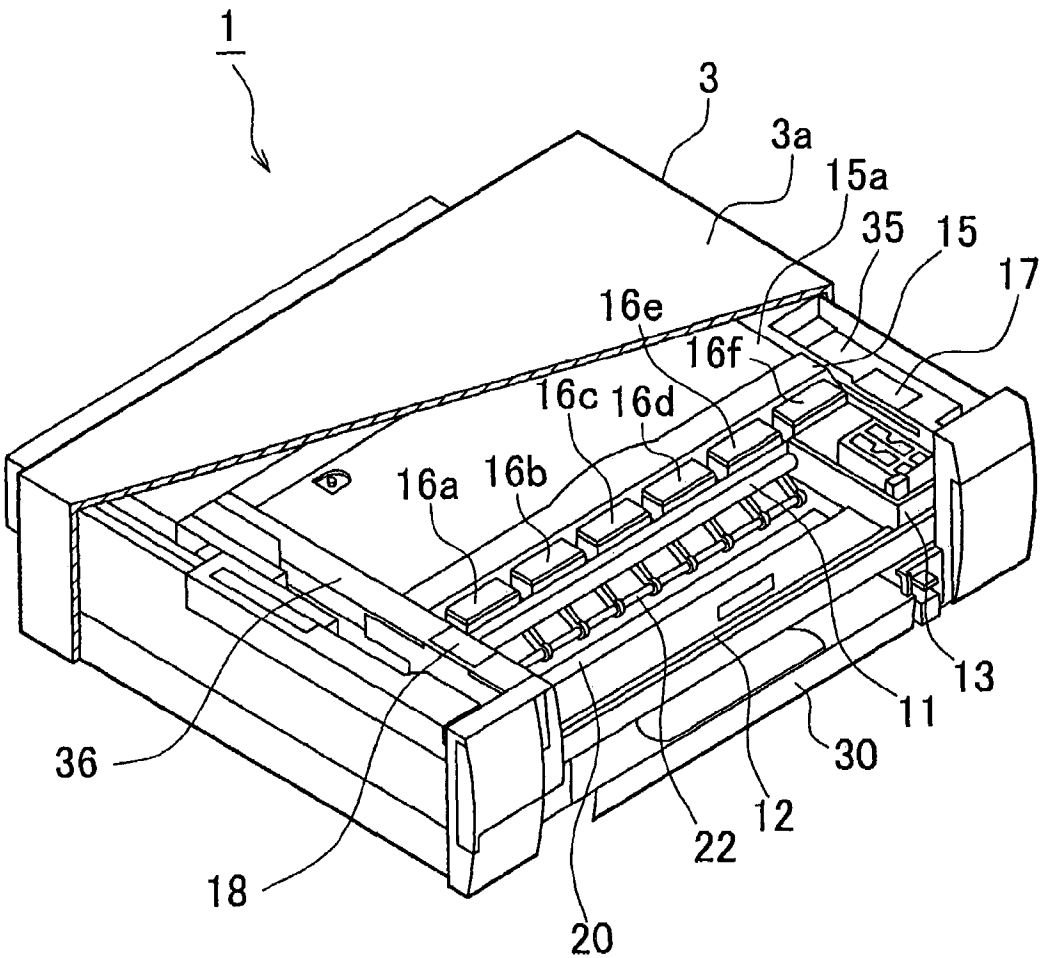
FIG. 11 shows a perspective view of the inside of the printer of the present invention.

Hereafter, the configuration of the ink cartridge unit 15 (hereafter, simply referred to as "unit") and retreat means of the unit 15 (ink cartridge 16) will be described in detail referring to FIG. 1 and FIGS. 3 to 11. Here, FIG. 3 shows a perspective view of the inside of the printer 1, FIG. 4 shows a partially exploded perspective view of the unit 15, FIGS. 5 and 6 show partially enlarged views of the unit 15, and FIG. 7 shows a perspective view of another example of a cap member. And FIG. 8 shows a perspective view of the unit 15, FIG. 9 shows a perspective view of a guide member 36, FIG. 10 shows a perspective view of lock means, and FIG. 11 shows a perspective view of the inside of the printer 1.

The unit 15 is provided on a front and upper section of the printer 1 as described in connection with FIG. 1, and as shown in FIG. 3 it includes a plurality of ink cartridges 16*a* to 16*f* (hereafter, referred to as a whole as "ink cartridges 16" for the sake of description) which are separate for each of a plurality of colors in a row in the lateral direction of the printer 1.

The ink cartridges 16 are provided detachably, so that they are pulled out in the forward direction of the printer 1 and separated from the unit 15 when they are replaced, whereas they are pushed into the unit 15 in the backward direction of the printer 1 when they are mounted, whereby a liquid supply needle which is not shown and provided for each of the ink cartridges 16 is inserted into the ink supply opening which is not shown of the ink cartridge 16.

Figure 8:
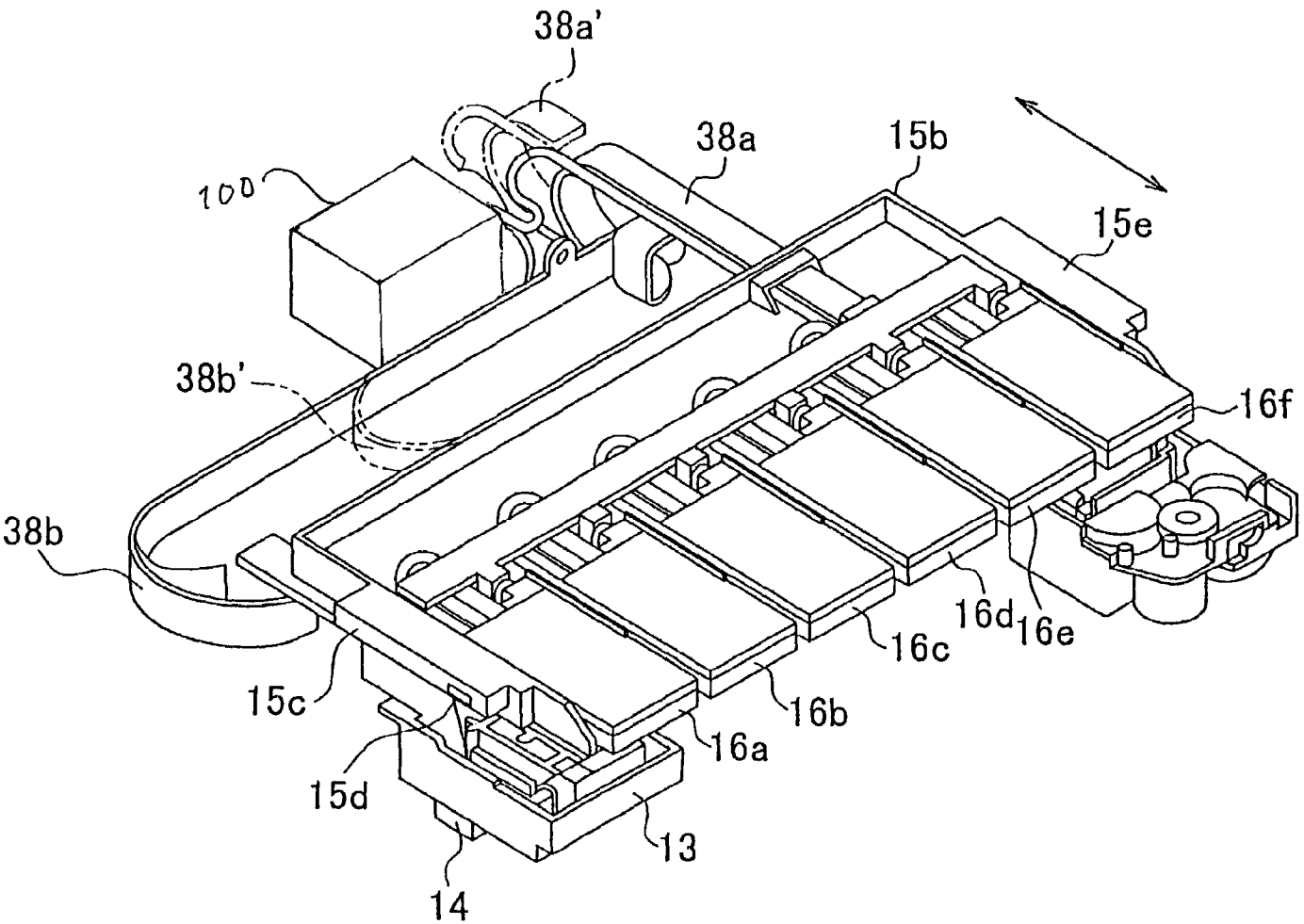
FIG. 8 shows an enlarged view of the ink cartridge unit.

More particularly, the unit 15 includes the ink cartridges 16 in a body 15*b* which is shaped like a tray as shown in FIGS. 3 and 8, and a decorative plate 15*a* is attached above the body 15*b* as a plate (cover) for forming the top appearance of the printer 1 together with the housing 3 as shown in FIG. 1.

Next, a cap member 50 is mounted on front sections of the body 15*b* and the decorative plate 15*a*. The cap member 50 has the shape to cover the front sections of the body 15*b* and the decorative plate 15*a*, and when the cap member 50 is mounted, the body 15*b* and the decorative plate 15*a* are prevented from being separated form each other, whereby the inside of the unit 15 is not easily exposed, and the safety is improved. In other words, when the inside of the unit 15 is exposed, the contact of the liquid supply needle described above or an IC chip (not shown) for holding the information (e.g. the amount of the rest of ink) about each of the cartridges might occurs, so a user can easily expose the inside of the unit 15, and the apparatus is likely to be broken. However, by the cap member 50, the inside of the unit 15 is not easily exposed, so the safety is obtained. Because of such reason, the cap member 50 is mounted (held) in order not to be easily separated by way of the following configuration.

In FIG. 4, the symbols 45*a* to 45*f* represent insertion openings into which the ink cartridges 16 are inserted, and tongue pieces 47*a* to 47*f* (hereafter, referred to as a whole as "tongue pieces 47" for the sake of description) each of which has the shape of an approximate triangle when viewed from its side and projects forward are formed between the insertion openings 45*a* to 45*f*. Partition sections 51*a* to 51*f* (hereafter, referred to as a whole as "partition sections 51" for the sake of description) each of which has the shape of an approximate triangle when viewed from its side are formed on the cap member 50 in order that ink cartridge insertion openings are partitioned in response to the insertion openings 45*a* to 45*f*.

Figure 6A:
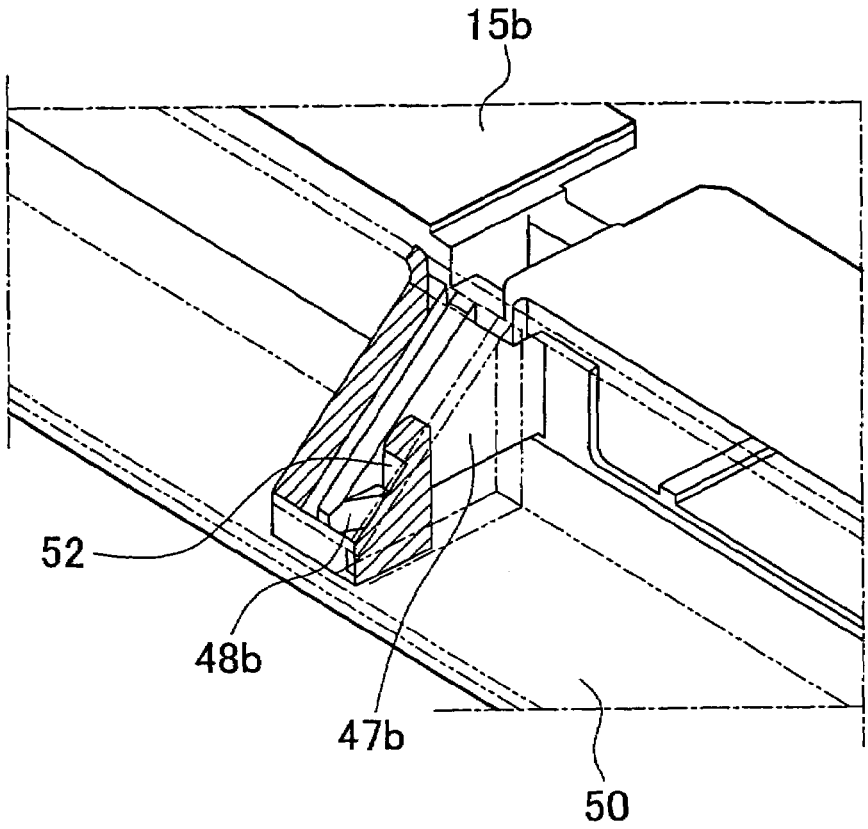
FIG. 6A and FIG. 6B show a partially enlarged view of the ink cartridge unit.

FIGS. 5 and 6 show sectional views of the inside of the partition sections 51. In FIG. 6A, the partition sections 51 have hollows therein so that the tongue pieces 51 can be inserted, and besides engagement sections 52 are formed. Meanwhile, engagement projections 48 (48*c* in FIG. 5 and 48*b* in FIG. 6A) are formed on the ends of the tongue pieces 47, so that when the tongue pieces 47 are inserted into the partition sections 51, the engagement projections 48 get over the engagement sections 52 by the elasticity of the tongue pieces 47 and come into an engagement state as shown in the drawing. The tongue pieces 47*a* to 47*f* and the partition sections 51*a* to 51*f* have totally the same configuration, and thus the cap member 50 can be surely mounted on the body 15*b*.

Figure 6B:
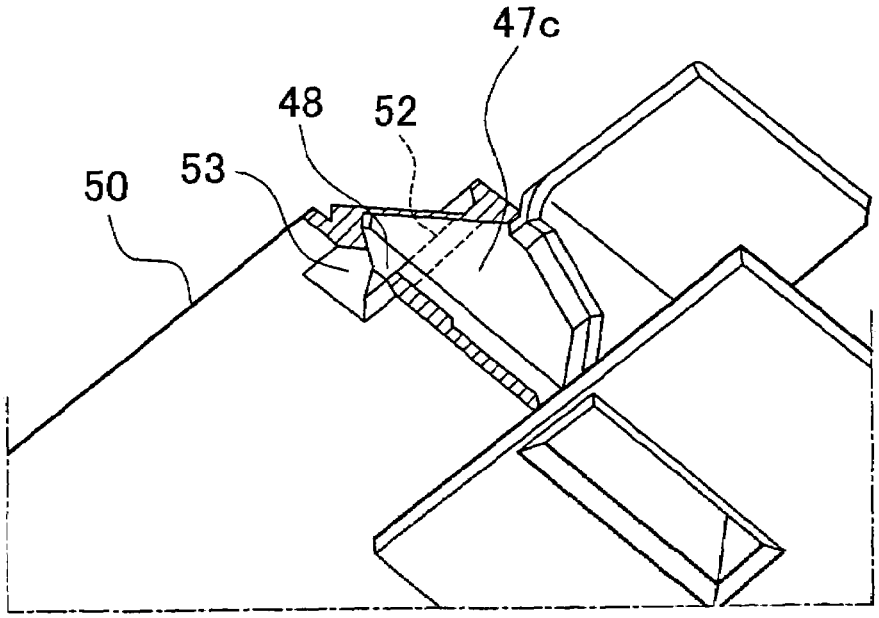

Further, window holes 53 shown in FIG. 6B are formed in bottom sections of the tongue pieces 51, and pins are inserted into the window holes 53, whereby the engagement state of the engagement projections 48 and the engagement sections 52 can be released.

Here, the engagement projection 48*a* projects forward against the drawing as shown in FIG. 5, the engagement projection 48*b* projects backward against the drawing, and the engagement projection 48*c* projects forward against the drawing, while the engagement projections formed on tongue pieces 47*d*, 47*e* and 47*f* also project in the alternating directions. In other words, if all of the engagement projections 48 are formed on the same sides of the tongue pieces 47, there is concern that when the cap member 50 is moved in a certain direction where the engagement projections 48 and the engagement sections 52 could be disengaged, the entire engagement of the engagement projections 48 and the engagement sections 52 might be released, whereby the cap member 50 could be separated by the user. However, since the engagement projections 48 are formed in such an alternating manner as they are formed on the left and right sides of the tongue pieces 47, the engagement state of the engagement projections 48 and the engagement sections 52 is not easily released, and the state in which the cap member 50 is mounted (held) is surely maintained.

Figure 7A:
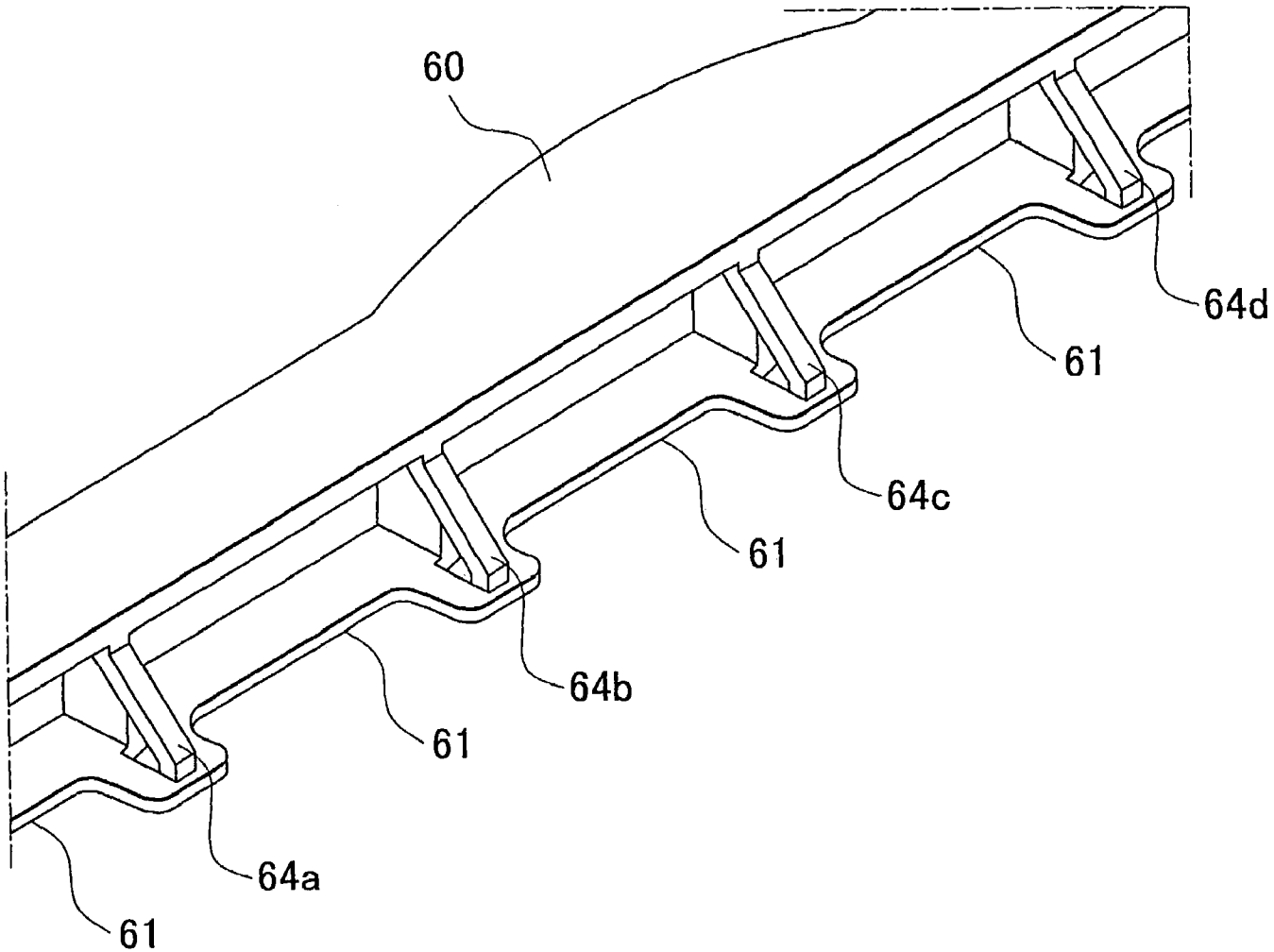
FIG. 7A and FIG. 7B, each shows a perspective view of another example of a cap member.
Figure 7B:
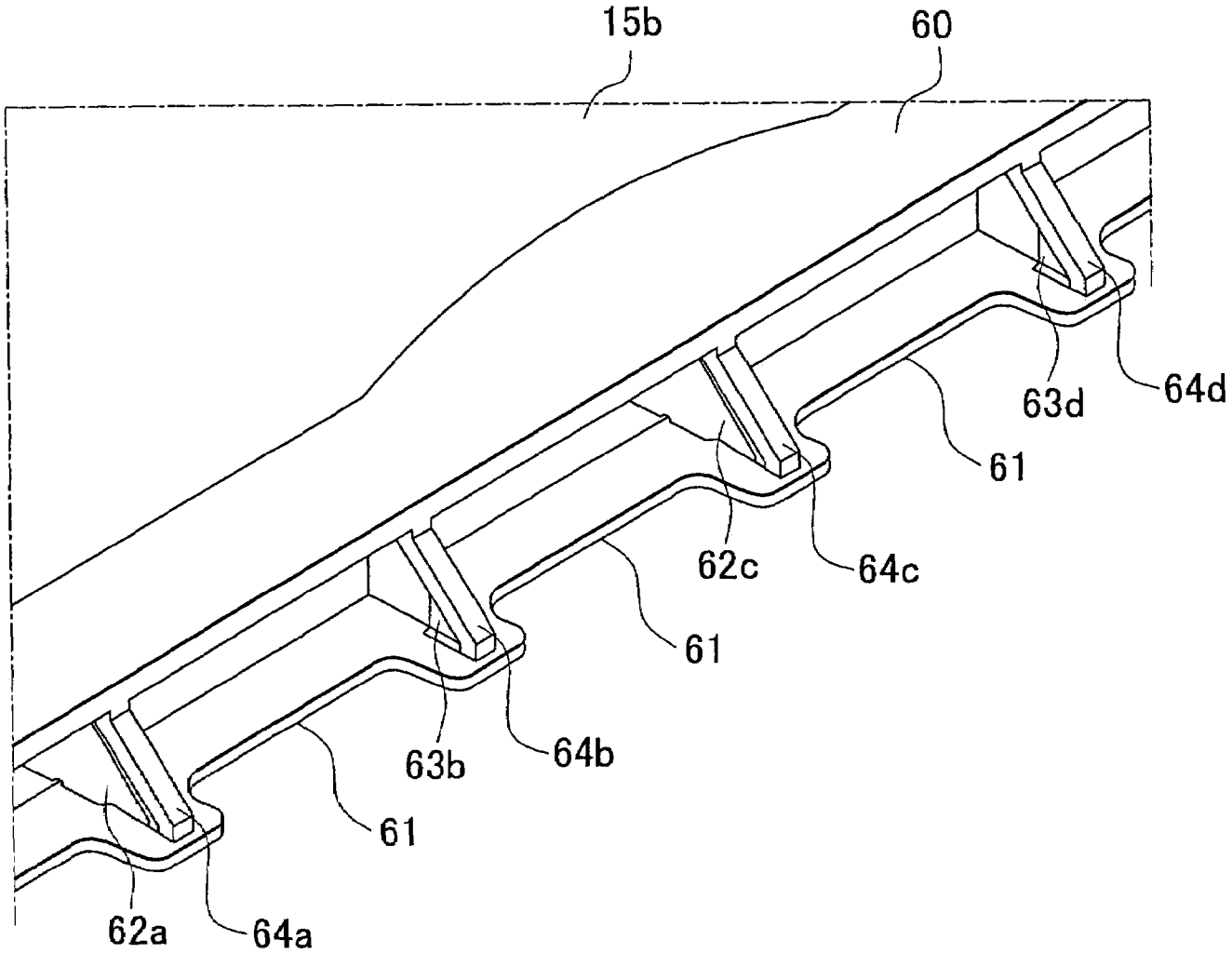

Further, the cap member 50 may be replaced by a cap member 60 shown in FIGS. 7A and 7B. First, the cap member 60 shown in FIGS. 7A and 7B has concave sections 61 which are formed in the insertion openings of the ink cartridges 16. These result from consideration of working efficiency in attachment and detachment of the ink cartridges 16. When the ink cartridges 16 are mounted, the concave sections 61 secure spaces into which a user pushes the ink cartridges 16 with his or her finger, and when the ink cartridges 16 are separated, it is easy to hold the ink cartridges 16, whereby the working efficiency in attachment and detachment of the ink cartridges 16 is improved.

And partition sections 64 (shown as symbols 64*a* to 64*d*) for partitioning the ink cartridge insertion openings of the cap member 60 do not have hollows for insertion of tongue pieces 62 (shown as symbols 62*a* to 62*c*) but are configured to be recognized from outside as shown in the drawing, and engagement projections 63 (shown as symbols 63*b* to 64*d*) are configured to be exposed to outside. Accordingly, the working efficiency in separation of the cap member 60 when a trouble occurs is excellent, and since the engagement projections 63 face in different directions from each other as described above, the cap member 60 is not easily separated by a user.

And as shown in FIG. 3, since the unit 15 is provided above the main scanning area of the carriage 13, and the lower section of the carriage 13 is a part of the paper transfer path along which the recording paper P is transferred, maintenance work when a trouble occurs, e.g. elimination of a paper when the paper jams becomes difficult. Accordingly, the printer 1 includes retreat means for making the unit 15 (ink cartridges 16) retreat from an area above or in the vicinity of the main scanning area of the carriage 13.

Knobs shown as symbols 17 and 18 in FIG. 3 are unit retreat knobs, and they are slid in the forward direction of the printer 1, so that the holding state of the unit 15 is released, whereby the unit 15 retreats to a retreat position as shown in FIG. 11. Accordingly, a space above the main scanning area of the carriage 13 can be secured, and the maintenance work when a trouble occurs in the paper transfer path can be easily performed.

FIG. 8 shows a perspective view of the unit 15 from which the decorative plate 15*a* (cf. FIG. 3) is separated and ink supply means for supplying ink from the unit 15 to the carriage 13 and finally to the recording head 14. An ink supply control section 100 is installed in the ink supply means and regulates the status of ink flowing within the ink supply means such as pressure or flowrate. Guided sections 15*c* (left) and 15*e* (right) are formed on both sides of the body 15*b* projecting from the both sides in the lateral direction. Meanwhile, right and left guide members 35 and 36 are formed on the body of the printer 1 as shown in FIG. 3 positioned on both sides of the unit 15.

FIG. 9 shows a perspective view of the left guide member 36. Further, since the right and left guide members 35 and 36 are laterally symmetrical as well as having the same basic configuration, the left guide member 36 will be hereafter described. The left guide member 36 has the shape of a rod which extends in the longitudinal direction of the printer 1, and a guide groove 36*a* is formed on its side facing the unit 15 extending in the longitudinal direction of the printer 1. And the guided section 15*c* is loosely fitted with the guide groove 36*a*, so that the unit 15 can slide in the longitudinal direction of against the printer 1.

Here, since the guide groove 36*a* is formed in an approximately straight line, the unit 15 slides on both the non-retreat position (FIG. 3) and the retreat position (FIG. 11) horizontally and straight. Accordingly, the decorative plate 15*a* which forms a top surface of the unit 15 is configured to be positioned below a top plate 3*a* of the housing 3 in order that the decorative plate 15*a* does not interfere with the top plate 3*a* of the housing 3. And when the unit 15 slides, the decorative plate 15*a* slides horizontally on an inner top surface (a bottom surface of the top plate 3*a*) of the housing 3. Accordingly, even if any medium mounted exists on the top surface of the housing 3, the unit 15 can retreat to the retreat position without interference with it.

The unit retreat knob 18 is provided on the left guide member 36 close to the front of the printer 1, and a stopper member 41 is provided on the section where the unit retreat knob 18 is provided. Meanwhile, a fitting hole 15*d* is formed in the guided section 15*c* as shown in FIG. 11, and the stopper member 41 is configured to be fitted with the fitting hole 15*d* as shown in FIG. 10. Accordingly, when the unit 15 is in the non-retreat position (FIG. 3), the unit 15 is held in the non-retreat position by the stopper means as described above.

And a spring 42 as energizing means is provided on the left guide member 36 in FIG. 10 to energize the guided section 15*c* in the backward direction of the printer 1 (towards the retreat position of the unit 15). Accordingly, when the unit retreat knob 18 is slid, the stopper member 41 is separated from the fitting hole 15*d*, so that the unit 15 becomes free, and the unit 15 slides towards the retreat position by the energizing force of the spring 42, whereby the unit 15 can retreat to the retreat position with simple handling.

As described above, since the ink cartridges 16 are not mounted on the carriage 13, the ink flow path which connects the ink cartridges 16 and the carriage 13 is necessarily configured to be flexible in response to the reciprocating operation of the carriage 13 in the main scanning direction and the sliding operation of the unit 15 between the retreat position and the non-retreat position. Accordingly, in this embodiment as shown in FIG. 8, the ink cartridges 16 and the carriage 13 are connected by band-shaped members 38*a* and 38*b* made of elastomer, which are the ink flow paths (not shown) in response to each color. Therefore, the band-shaped member 38*a* can be deformed as shown by the symbol 38*a*' even though the unit 15 slides to the retreat position, whereas the band-shaped member 38*b* can be deformed as shown by the symbol 38*b*' even though the carriage 13 reciprocates in the main scanning direction.

As above, although a trouble occurs in the paper transfer path, the unit 15 retreats to the retreat position, whereby the maintenance work can be easily performed.

Figure 12:
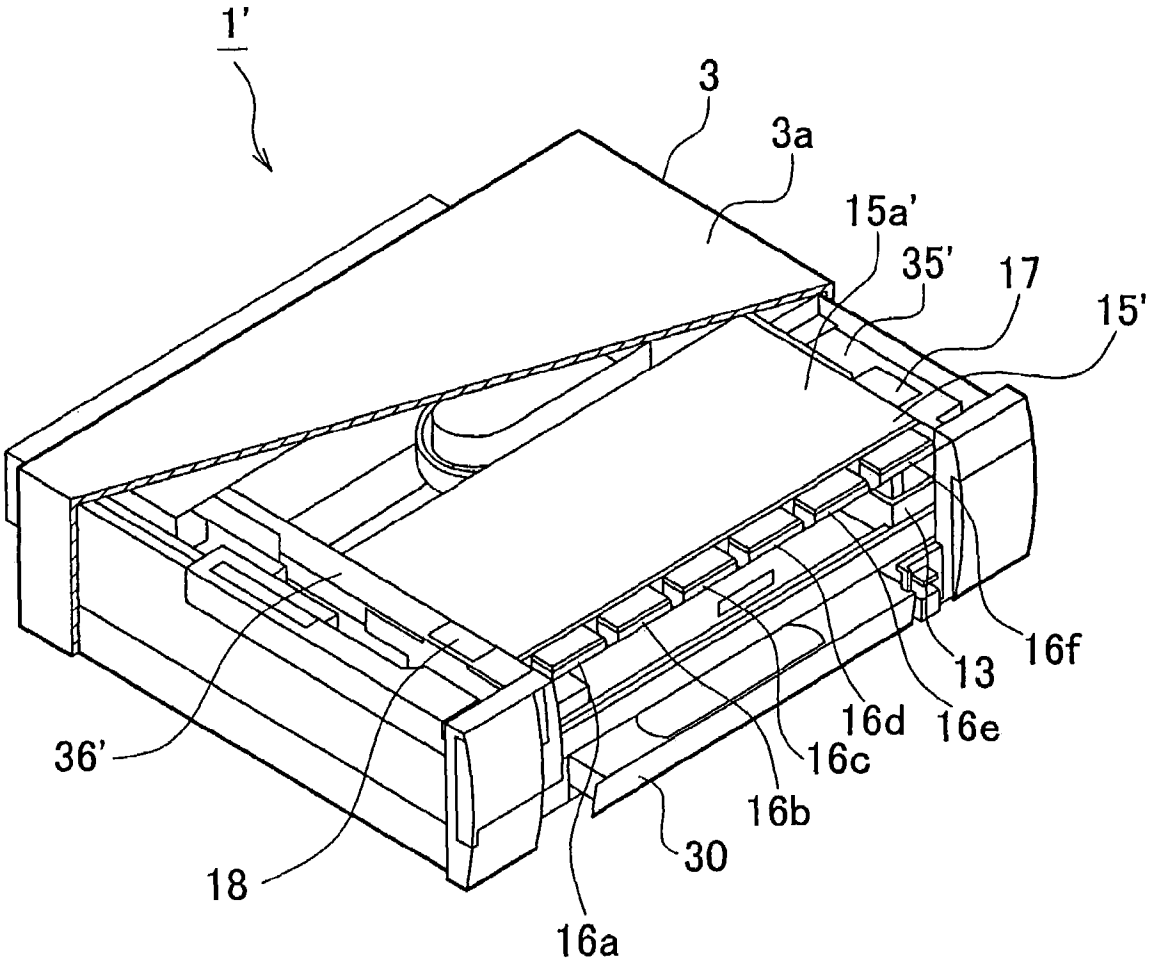
FIG. 12 shows a perspective view of the inside of the printer of a second embodiment.
Figure 13:
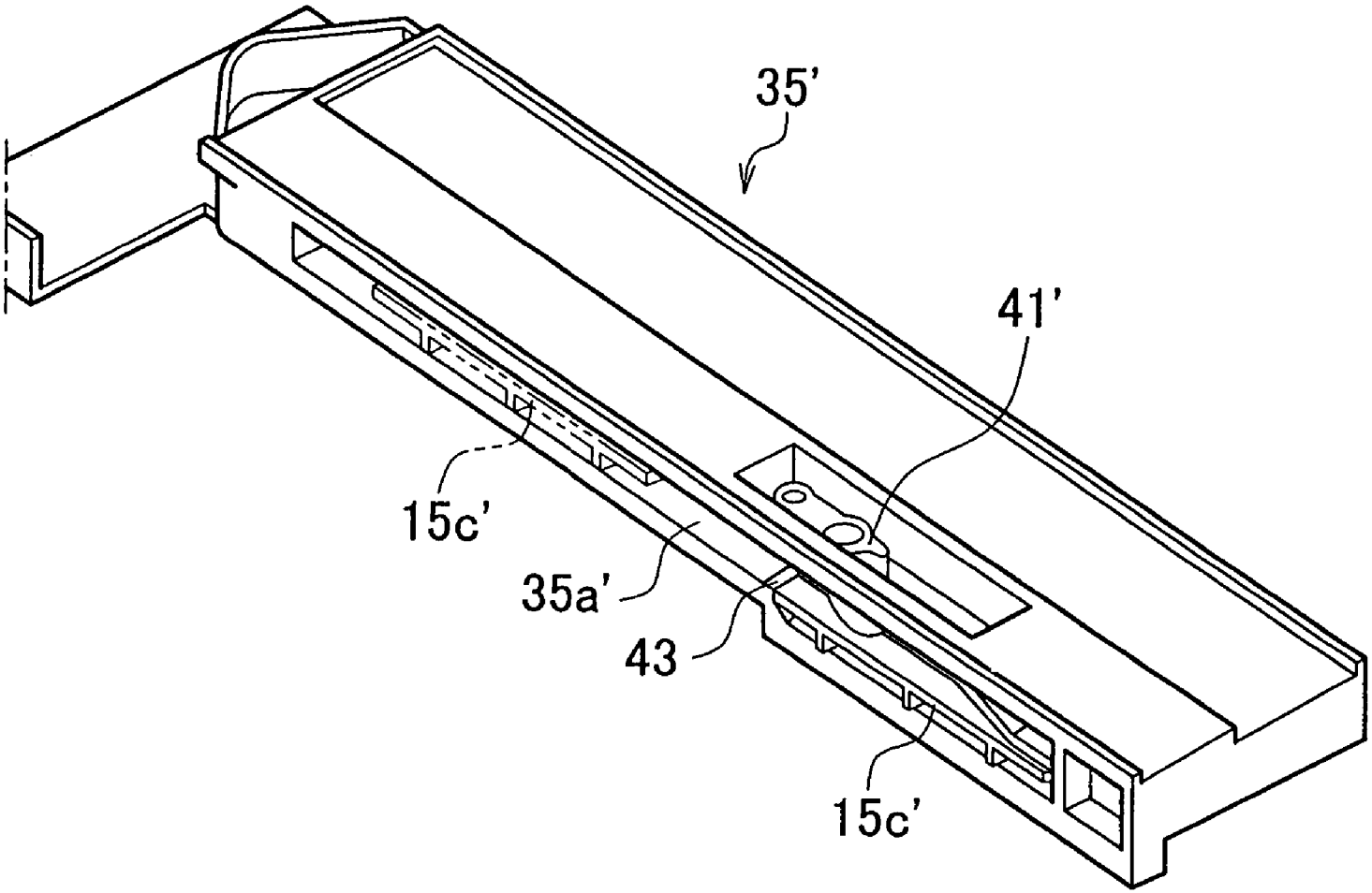
FIG. 13 shows a perspective view of a guide member of the second embodiment.
Figure 14:
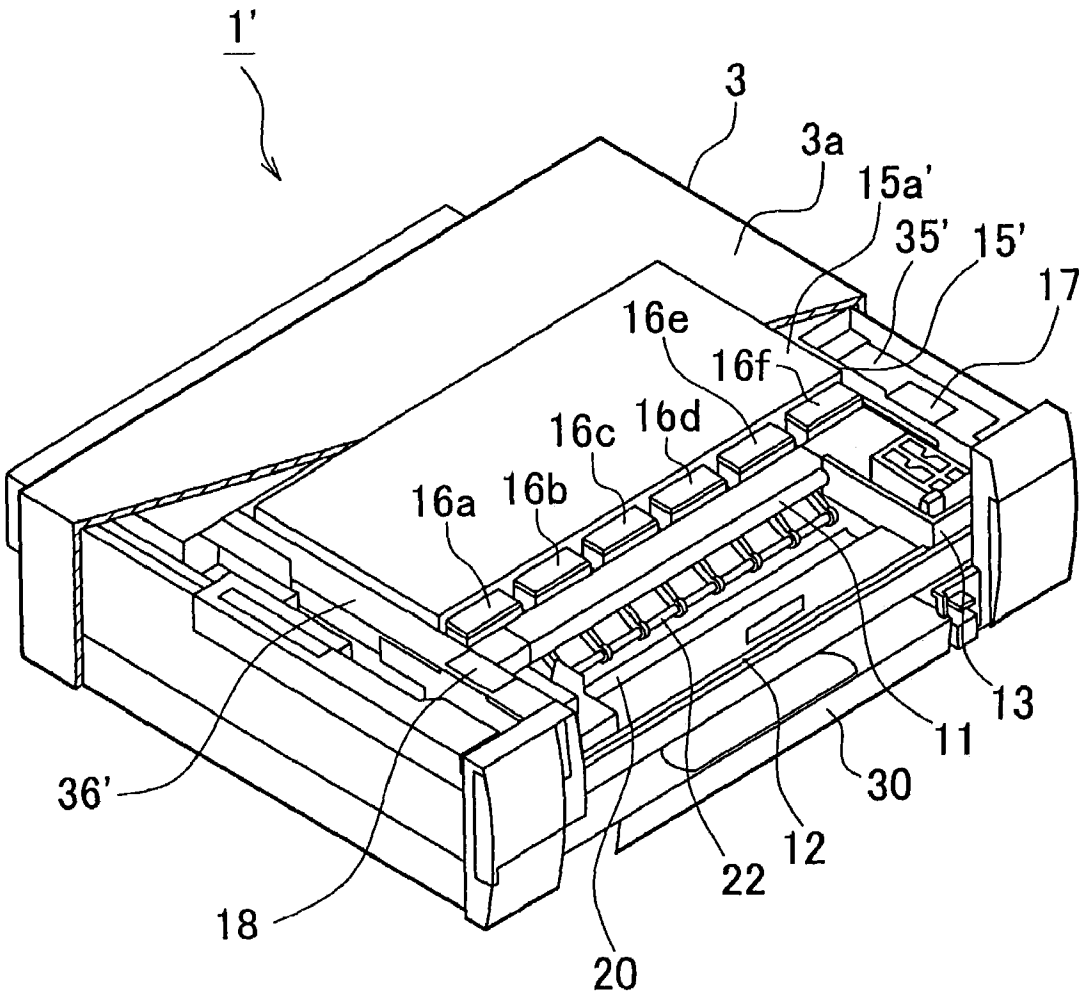
FIG. 14 shows a perspective view of the inside of the printer of the second embodiment.

Next, a printer 1' according to a second exemplary embodiment of the present invention will be described referring to FIGS. 12 to 14. Here, FIGS. 12 and 14 show perspective views of the inside of the printer 1' of the second embodiment, and FIG. 13 shows a perspective view of a guide member 35'. Further, the elements the same as those of the first embodiment are given the same symbols and will not be hereafter described, and different elements which are attached with superscripts "'" or "''" will be mainly described.

In FIG. 12, the printer 1' of the second embodiment is configured with a decorative plate 15*a*' which forms a top surface of a unit 15' so that the decorative plate 15*a*' forms the same surface (flat plane) together with the top plate 3*a* of the housing 3 in contrast to the first embodiment described above. Accordingly, when the unit 15' slides to the retreat position, the decorative plate 15*a*' and the top plate 3*a* interfere with each other, so in order to prevent this situation, the unit 15*a*' is configured to slide to the retreat position after being moved upwards slightly in advance as shown in FIG. 14. Therefore, the decorative plate 15*a*' runs over the top surface of the top plate 3*a* in the retreat position.

FIG. 13 shows a perspective view of a right guide member 35'. The right guide member 35' has a guide groove 35*a*' similar to that of the left guide member 36 of the first embodiment described, and a guided section 15*c*' is loosely fitted with the guide groove 35*a*' (only the guided section 15*c*' in response to the guided section 15 in FIG. 7 which is provided in the unit 15' in FIG. 12 is cut out and shown), whereby the unit 15' can slide. In addition, a stopper member 41' similar to the stopper member 41 described above is provided, whereby the unit 15' is held in the non-retreat position.

Here, in this embodiment, the guide groove 35*a*' is shaped like a step. Accordingly, the guided section 15*c*' climbs a sloping surface 43 when sliding to the retreat position, whereby the position of the unit 15' is changed upwards in advance, and then the unit 15' slides to the retreat position as shown by the imaginary line.

According to the second embodiment, since the top surface of the printer 1' can be flat, its appearance is good.

Next, a printer 1" according to a third exemplary embodiment of the present invention will be described referring to FIGS. 15 and 16. Here, FIGS. 15 and 16 show perspective views of the inside of the printer 1" of the third embodiment.

Figure 15:
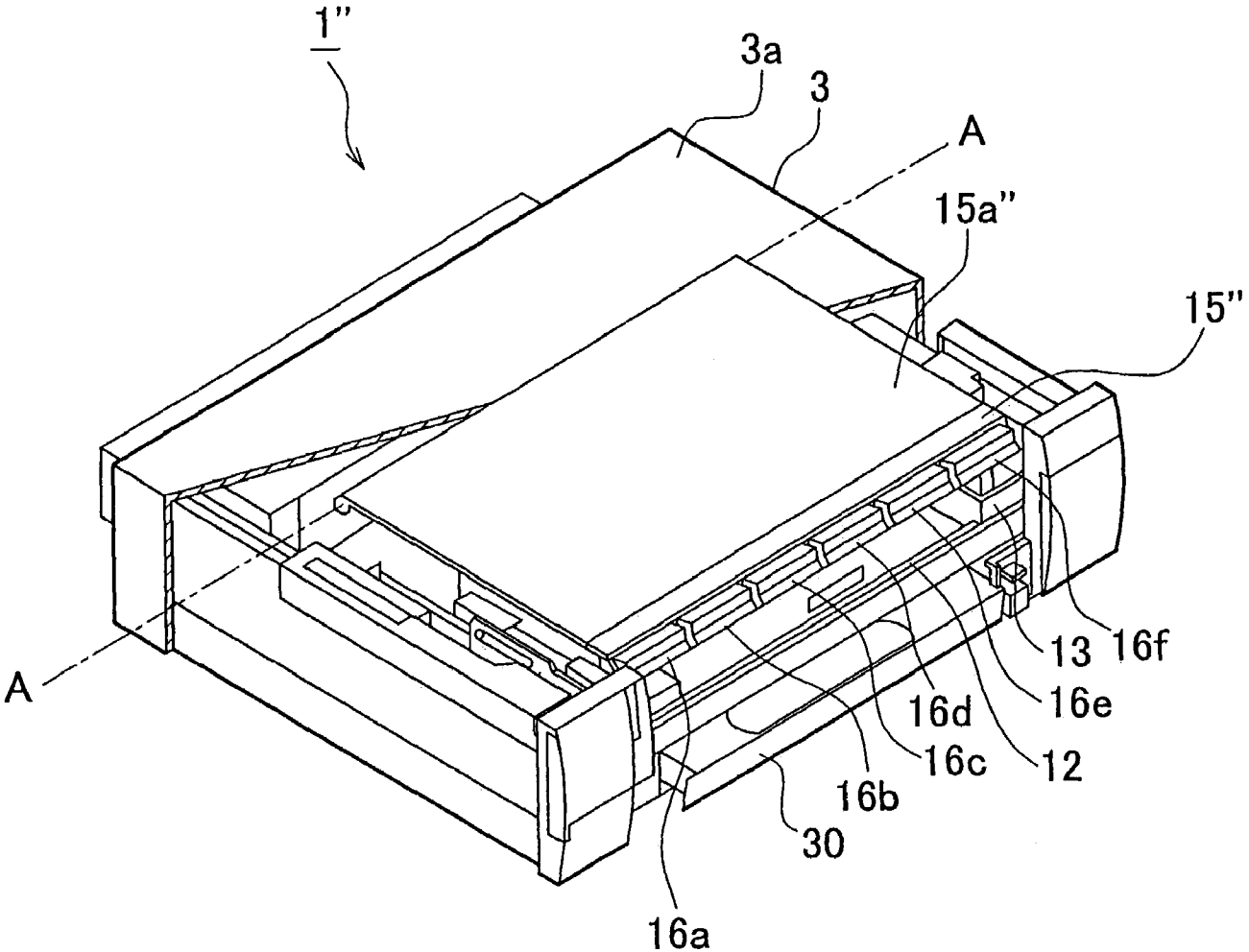
FIG. 15 shows a perspective view of the inside of a printer of a third embodiment.

In FIG. 15, the printer 1" of the third embodiment is configured with a decorative plate 15*a*" which forms a top surface of a unit 15" so that the decorative plate 15*a*" forms the same surface (flat plane) together with the top plate 3*a* of the housing 3 similar to the second embodiment described above.

Figure 16:
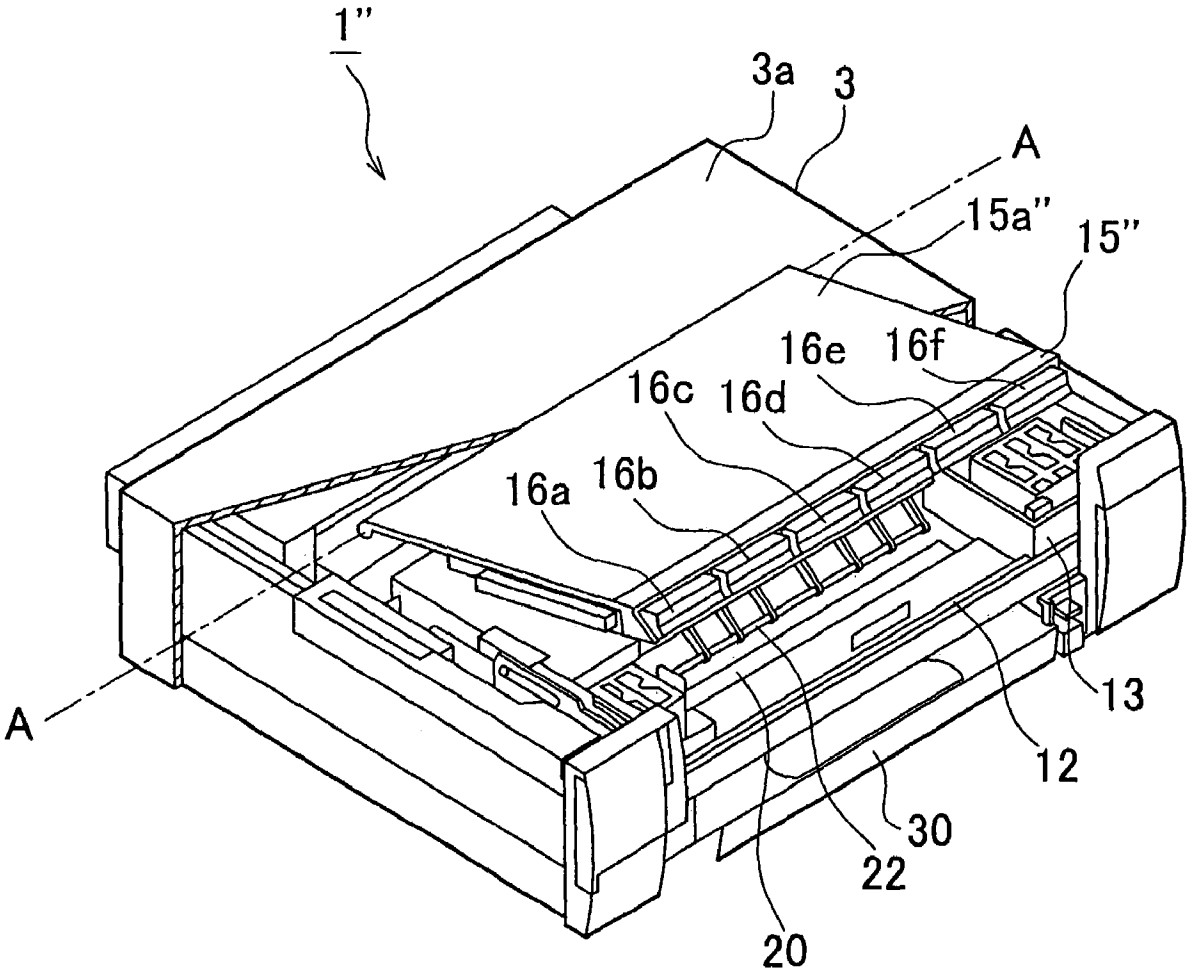
FIG. 16 shows a perspective view of the inside of the printer of the second embodiment.

However, the unit 15" does not secure a space above the main scanning area of the carriage 13 by way of its sliding operation in contrast to the first and second embodiments described above, but it pivots on a rotation shaft (whose center axis line is represented by the symbol A-A) formed on a rear end section of the decorative plate 15*a*", whereby it secures a space above the main scanning area of the carriage 13 as shown in FIG. 16.

Therefore, according to the third embodiment, like the first embodiment, since the top surface of the printer 1" can be totally flat, its appearance is good.

As obvious from the description above, the present invention can be applied to an apparatus for putting liquid on a medium by ejecting the liquid onto the medium from a liquid ejecting head of a recording apparatus or liquid ejecting apparatus represented by a FAX, printer, etc.

Although the present invention has been described by way of exemplary embodiments, it should be understood that those skilled in the art might make many changes and substitutions without departing from the spirit and the scope of the present invention which is defined only by the appended claims.

What is claimed is:

1. A recording apparatus which comprises a recording head for performing recording on a recording medium, a carriage which reciprocates in a main scanning direction, and an ink cartridge provided separately from said carriage for supplying ink drops to said recording head, said recording apparatus comprising:

ink cartridge retreat means for positioning said ink cartridge in an area in the vicinity of a main scanning area of said carriage or making said ink cartridge retreat from said area in the vicinity of said main scanning area of said carriage, wherein said ink cartridge retreat means makes said ink cartridge unit retreat from said area above said main scanning area of said carriage; and an ink cartridge unit for detachably holding a plurality of said ink cartridges which are arranged along said main scanning direction of said carriage, wherein said ink cartridge unit comprises:

a body for mounting said ink cartridge, said body comprising a plurality of tongue pieces which extend in a forward direction of said recording apparatus, each of said tongue pieces comprising an engagement projection on a side surface of an end section of said tongue piece;

a cover for covering a top section of said body, said cover comprising a plurality of engagement sections for engagement with said engagement projections; and a cap member for capping front sections of said body and cover, said engagement projections are engaged with said engagement sections by elasticity of said tongue pieces, whereby said cover is held, and said engagement projections are alternately formed on left and right side surfaces of said tongue pieces;

wherein said recording medium is transferred along a recording medium transfer path via said recording head.

* * * * *